US007654617B2

(12) United States Patent
Farnsworth

(10) Patent No.: US 7,654,617 B2
(45) Date of Patent: Feb. 2, 2010

(54) FLEXIBLE CHAIR SEAT

(75) Inventor: Orrin C. Farnsworth, Santaquin, UT (US)

(73) Assignee: Mity-Lite, Inc., Orem, UT (US)

( * ) Notice: Subject to any disclaimer, the term of this patent is extended or adjusted under 35 U.S.C. 154(b) by 0 days.

(21) Appl. No.: 12/134,386

(22) Filed: Jun. 6, 2008

(65) Prior Publication Data

US 2009/0302651 A1 Dec. 10, 2009

(51) Int. Cl.
*A47C 7/14* (2006.01)

(52) U.S. Cl. ..... 297/452.56; 297/452.13

(58) Field of Classification Search ..... 297/452.13, 297/452.56, 452.63
See application file for complete search history.

(56) References Cited

U.S. PATENT DOCUMENTS

| | | | | |
|---|---|---|---|---|
| 30,858 | A | 12/1860 | Pratt | |
| 71,045 | A | 11/1867 | Nicolai | |
| 116,811 | A | 7/1871 | Collignon | |
| 128,767 | A | 7/1872 | Viele | |
| 133,503 | A | 11/1872 | Travis et al. | |
| 157,028 | A | 11/1874 | Savoral | |
| 169,748 | A | 11/1875 | Wakefield | |
| 190,827 | A | 5/1877 | Closterman, Jr. | |
| 198,421 | A | 12/1877 | Smith | |
| 210,842 | A | 12/1878 | Dick | |
| 451,556 | A | 5/1891 | Hallett | |
| 473,704 | A | 4/1892 | Le Count | |
| 481,816 | A | 8/1892 | Perry | |
| 504,446 | A | 9/1893 | Dodd | |
| 77,327 | A | 1/1905 | Stiggleman | |
| 779,327 | A | 1/1905 | Stiggleman | |
| 898,235 | A | 9/1908 | Lloyd | |
| 945,032 | A | 1/1910 | Gillespie | |
| 976,786 | A | 11/1910 | Moulin | |
| 1,355,669 | A | 10/1920 | Henry | |
| 1,591,550 | A | 7/1926 | Rosenthal | |
| 1,608,911 | A | 11/1926 | Smith | |
| 1,740,806 | A | 12/1929 | Clarin | |
| 1,815,643 | A | 7/1931 | Allerding | |
| 1,838,213 | A | 12/1931 | Buffington | |
| 1,874,434 | A | 8/1932 | Brown | |
| 1,900,486 | A | 3/1933 | Clarin | |
| 1,975,622 | A | 10/1934 | Schermerhorn | |
| 1,989,865 | A | 2/1935 | Johanson | |
| 2,126,439 | A | 8/1938 | Zerbee | |
| 2,186,301 | A | 1/1940 | La More | |
| 2,262,500 | A | 11/1941 | Johannsen | |
| 2,303,189 | A | 11/1942 | Adler | |
| 2,371,954 | A * | 3/1945 | Cunningham | 297/452.56 X |
| 2,514,125 | A | 7/1950 | Evans | |
| 2,568,269 | A | 9/1951 | Burnham et al. | |

(Continued)

*Primary Examiner*—Rodney B White
(74) *Attorney, Agent, or Firm*—Thorpe North & Western LLP

(57) ABSTRACT

A chair seat for flexibly supporting the buttocks of a user seated thereon. The chair seat includes a seat surface having a pair of adjacent or side-by-side concentric corrugated regions formed therein, and which are configured for flexibly supporting the buttocks of the user by being deflectable with respect to the seat surface. The seat surface further includes a third corrugated region surrounding and concentric with the pair of side-by-side corrugated regions, and which third region is configured for flexibly supporting the hips and thighs of the user while also being deflectable with respect to the seat surface.

15 Claims, 4 Drawing Sheets

U.S. PATENT DOCUMENTS 2,874,755 A 2/1959 Smith
2,982,339 A 5/1961 Clarin
3,001,816 A 9/1961 Clarin
3,031,227 A 4/1962 Van Buren, Jr.
3,057,660 A 10/1962 Hans-Joachim Schneider
3,059,919 A 10/1962 Marchino
3,087,755 A 4/1963 Boman
3,125,156 A 3/1964 Grimshaw
3,154,345 A * 10/1964 Lambrecht ..... 297/452.56 X
3,220,764 A 11/1965 Duer
3,233,885 A 2/1966 Propst
3,291,529 A 12/1966 Straits
3,363,943 A 1/1968 Getz et al
3,463,547 A 8/1969 Brennan et al.
3,529,866 A 9/1970 Getz
3,531,157 A 9/1970 Duckett et al
3,635,524 A * 1/1972 Faust ..... 297/452.56 X
3,639,001 A 2/1972 Anderson
3,669,496 A 6/1972 Chisholm
3,695,687 A 10/1972 Uyeda
3,712,666 A 1/1973 Stoll
3,802,734 A 4/1974 Lindley
3,838,884 A 10/1974 Faiks et al.
3,840,269 A 10/1974 Ambrose
3,847,433 A 11/1974 Acton et al.
4,235,473 A 11/1980 Aginar
4,319,779 A 3/1982 Leonhart
4,368,917 A 1/1983 Urai
4,451,085 A 5/1984 Franck et al.
4,492,408 A * 1/1985 Lohr ..... 297/452.56 X
4,498,702 A 2/1985 Raftery
4,502,731 A 3/1985 Snider
4,533,174 A 8/1985 Fleishman
4,549,764 A 10/1985 Haedo
4,557,521 A 12/1985 Lange
4,580,836 A 4/1986 Verney
4,582,361 A * 4/1986 Kennel ..... 297/452.56
4,585,272 A 4/1986 Ballarini
4,603,904 A 8/1986 Tolleson et al.
4,660,887 A 4/1987 Fleming et al.
4,756,575 A 7/1988 Dicks
4,790,595 A 12/1988 Hensel et al.
4,869,552 A 9/1989 Tolleson et al.
4,883,320 A * 11/1989 Izumida et al. ..... 297/452.56
4,913,493 A 4/1990 Heidmann
4,953,913 A 9/1990 Graebe
4,962,964 A 10/1990 Snodgrass
4,978,168 A 12/1990 Piretti
5,002,337 A 3/1991 Engel et al.
5,039,163 A 8/1991 Tolleson
5,040,848 A 8/1991 Irie et al.
5,064,247 A 11/1991 Clark et al.
5,071,191 A 12/1991 Leib
5,096,259 A 3/1992 Stanfield
5,108,149 A 4/1992 Ambasz
5,110,186 A 5/1992 Clark et al.
5,154,485 A 10/1992 Fleishman
5,183,314 A 2/1993 Lorbiecki
5,297,851 A 3/1994 Van Hekken
5,383,712 A 1/1995 Perry
5,513,899 A 5/1996 Michaels et al.
5,611,598 A 3/1997 Knoblock
5,738,408 A 4/1998 Wu
5,747,140 A * 5/1998 Heerklotz ..... 297/452.56 X
5,779,317 A 7/1998 Neal
5,820,221 A 10/1998 Greaves et al.
5,825,095 A 10/1998 Albecker, III
5,860,697 A 1/1999 Fewchuk
5,860,700 A 1/1999 Lance
5,863,096 A 1/1999 Bartlmae
5,871,258 A 2/1999 Battey et al.
5,887,946 A 3/1999 Raftery
5,902,012 A 5/1999 Han
5,904,397 A 5/1999 Fismen
5,934,758 A 8/1999 Ritch et al.
5,947,562 A 9/1999 Christofferson et al.
5,954,391 A 9/1999 Gray
5,967,605 A 10/1999 Stanfiled
5,975,634 A 11/1999 Knoblock et al.
5,988,746 A 11/1999 Raftery
6,030,037 A 2/2000 Ritch et al.
6,056,354 A 5/2000 Tseng
6,065,803 A 5/2000 Li et al.
6,095,597 A 8/2000 Huang
6,099,073 A 8/2000 Bruschi
6,116,694 A 9/2000 Bullard
6,135,562 A 10/2000 Infanti
6,193,318 B1 * 2/2001 Becker et al. ..... 297/452.56 X
6,234,571 B1 5/2001 Atkins et al.
6,279,991 B1 8/2001 Atkins et al.
6,279,998 B1 8/2001 Chu et al.
6,305,742 B1 10/2001 Spendlove et al.
6,305,750 B1 10/2001 Buono et al.
6,349,992 B1 2/2002 Knoblock et al.
6,382,728 B1 5/2002 Buono
6,386,627 B1 5/2002 Tsai
6,406,096 B1 6/2002 Barile, Sr.
6,409,268 B1 6/2002 Cvek
D460,300 S 7/2002 Fifield et al.
6,412,869 B1 7/2002 Pearce
6,422,645 B1 7/2002 Smith et al.
6,471,293 B2 10/2002 Ware et al.
6,533,352 B1 3/2003 Glass et al.
6,726,285 B2 4/2004 Caruso et al.
6,779,846 B2 8/2004 Spendlove et al.
6,935,698 B1 8/2005 Chen
7,021,712 B2 4/2006 Spendlove et al.
7,111,906 B2 9/2006 Heisey et al.
2002/0117883 A1 8/2002 Gevaert

* cited by examiner

1/4

2/4

FLEXIBLE CHAIR SEAT

FIELD OF THE INVENTION

The field of the invention relates to flexible seats for chairs for sitting on.

BACKGROUND OF THE INVENTION AND RELATED ART

Chairs and sitting devices have been subject to constant efforts to improve the ease, comfort, style or cost of the way people sit. With the advent of the age of plastics, additional options became available for low cost or portable chairs that could be injection-molded into a variety of shapes and sizes. As plastics can be made quite flexible and elastic, the chairs could also be designed to provide an additional measure of structural flexibility, and therefore comfort, than could be provided with seat platforms or sitting surfaces made from more rigid materials, such as wood, metal, ceramics, etc.

Simple plastic chairs have material limitations, however, which include the permanent deformation and damage that can result from excess loads. It has been discovered that in order to make chairs from flexible materials, such as plastic, thin metal sheets, etc., elasticity and strength are generally inversely proportional. In other words, the flexible characteristics desired for improved comfort must often be sacrificed to maintain sufficient strength to accommodate anticipated abuse and overload conditions without experiencing permanent damage.

SUMMARY OF THE INVENTION

In light of the problems and deficiencies inherent in the prior art, the present invention seeks to overcome these by providing a chair seat that flexibly and comfortably supports the buttocks of a user seated thereon while avoiding damage caused by exceeding the seat's material limits. This can be accomplished through incorporation of flex elements into the structure of the seat, which can include a pair of adjacent, side-by-side concentric corrugated regions form in the seat surface that are configured for flexibly supporting the buttocks of the user, and which corrugate regions are deflectable with respect to the perimeter of the seat surface. The invention can further include a third corrugated region, or flex element, that surrounds and is concentric with the pair of side-by-side corrugated regions. The third region can be configured for flexibly supporting the hips and thighs of the user and for additional deflection with respect to the seat surface.

To assist with the downward deflection, the present invention can further include transverse notch lines extending radially through the corrugated regions, which notch lines subdivide the corrugated regions and allow for increased deflection across the seat member. The notches lines can cut through the slot bottoms and sidewalls of the slots, but not through the rib tops, as the plurality of rib tops provides a continuous yet conformable surface that comfortably supports the seated user while binding the subdivided sections of the corrugated regions together. The location and number of the notch lines can allow for fine tuning of the seat member's flexibility and durability.

In accordance with the invention as embodied and broadly described herein, the present invention can also reside in a chair for flexibly supporting a buttocks of a user seated thereon. The chair can include a seat member which comprises a flexible seat surface having a pair of adjacent concentric corrugated regions, or flex elements, formed and disposed side-by-side therein, and which are configured for flexibly supporting the buttocks of the user. The seat member can further comprise a third corrugated region, or flex element, that surrounds and is concentric with the pair of adjacent corrugated regions and is configured for flexibly supporting the hips and thighs of the user. The chair can also include one or more chair supports coupled to the seat member which elevate the member to a sitting height, as well as a back rest coupled to the seat member for resting a back portion of the user thereon.

BRIEF DESCRIPTION OF THE DRAWINGS

Features and advantages of the invention will be apparent from the detailed description that follows, and which taken in conjunction with the accompanying drawings, together illustrate features of the invention. It is understood that these drawings merely depict exemplary embodiments of the present invention and are not, therefore, to be considered limiting of its scope. Furthermore, it will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings, in which.

DETAILED DESCRIPTION OF EXEMPLARY EMBODIMENTS

Figure 1:
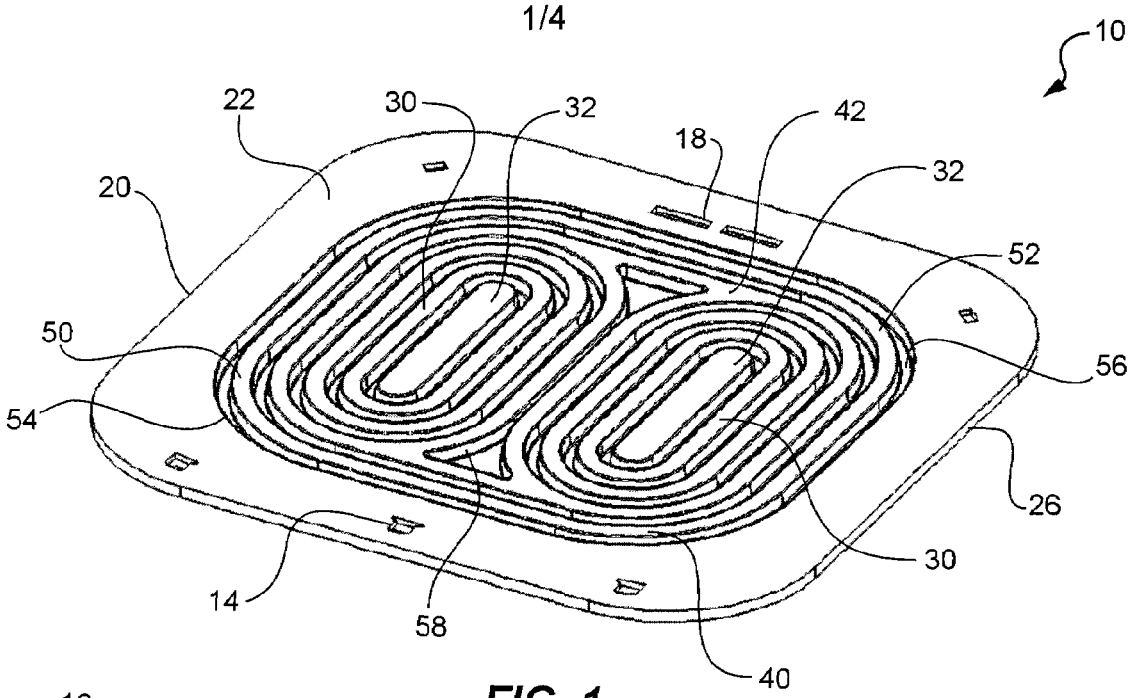
FIG. 1 illustrates a perspective top view of the flexible chair seat, according to an exemplary embodiment of the present invention.

The following detailed description of the invention makes reference to the accompanying drawings, which form a part thereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention. As such, the following more detailed description of the exemplary embodiments of the present invention is not intended to limit the scope of the invention as it is claimed, but is presented for purposes of illustration only: to describe the features and characteristics of the present invention, and to sufficiently enable one skilled in the art to practice the invention. Accordingly, the scope of the present invention is to be defined solely by the appended claims.

The present invention describes a flexible chair seat for flexibly supporting a buttocks of a user seated thereon. Integrated into the contact surface of the chair seat can be a number of accordion-like flex elements which interact under load to form a highly flexible seat member or platform, with a top sitting surface that provides firm support to the buttocks while simultaneously flexing to conform to the body shape of the user and reduce the number of pressure points. Although the flex elements can interact with each other in an intricate fashion, the seat member can be made from common, low-cost synthetic materials, such as plastic, polypropylene, polyethylene, nylon or equivalent polymer materials. This also allows for simple high-volume manufacturing techniques, such as injection molding, which can lead to economical and inexpensive production.

The present invention provides several significant advantages over prior related flexible chair seats, some of which are recited here and throughout the following more detailed description. For instance, by virtue of its design the present invention can be highly flexible when compared to chair seats made of comparable size and with similar materials, but having formed therein different flex elements and configurations, or no flex elements whatsoever. Indeed, the present invention can be 200% to 400% more flexible than prior related seat members, and without stretching the seat material or plastic beyond its elastic limits. Designing for high flexibility through the use of the mechanical interactions between flex elements formed into the seat, rather than relying solely on the flexible properties inherent in the seat material itself, provides for a flexible seat member that stays within its elastic range to maximize durability and longevity without sacrificing performance.

Each of the above-recited advantages will be apparent in light of the detailed description set forth below, with reference to the accompanying drawings. These advantages are not meant to be limiting in any way. Indeed, one skilled in the art will appreciate that other advantages may be realized, other than those specifically recited herein, upon practicing the present invention.

The following detailed description and exemplary embodiments of the flexible chair seat of the present invention will be best understood by reference to the accompanying drawings, wherein the elements and features of the invention are designated by numerals throughout.

Figure 2:
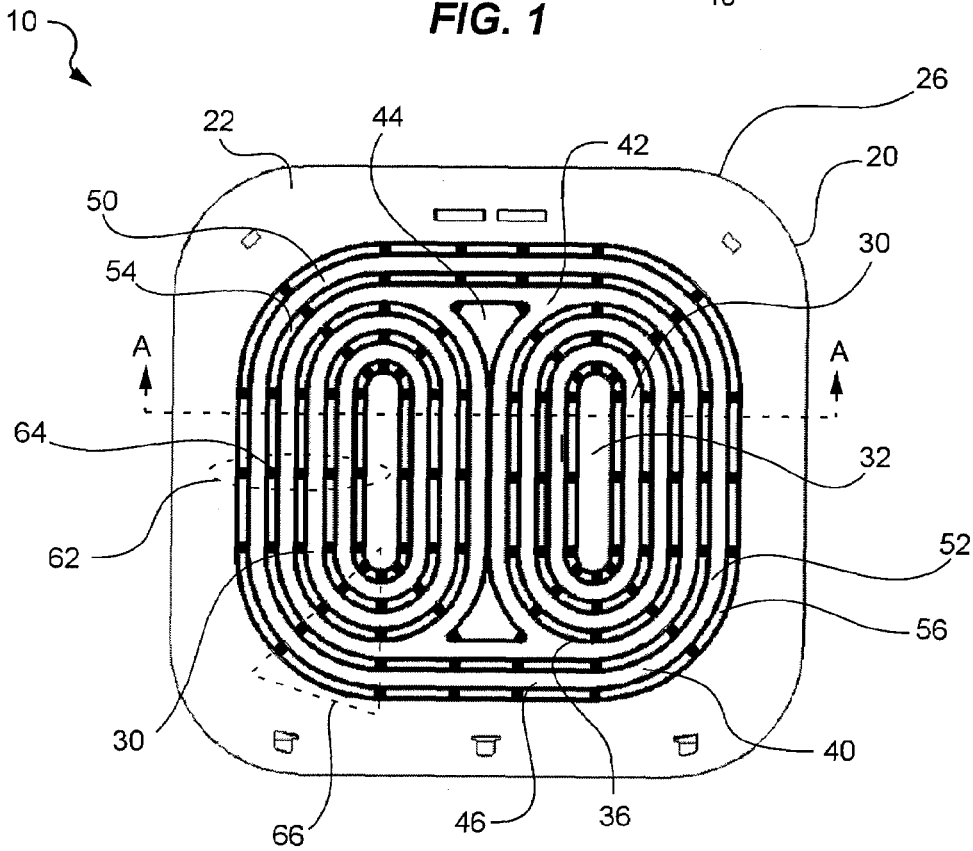
FIG. 2 illustrates a top view of the embodiment of FIG. 1.
Figure 6:
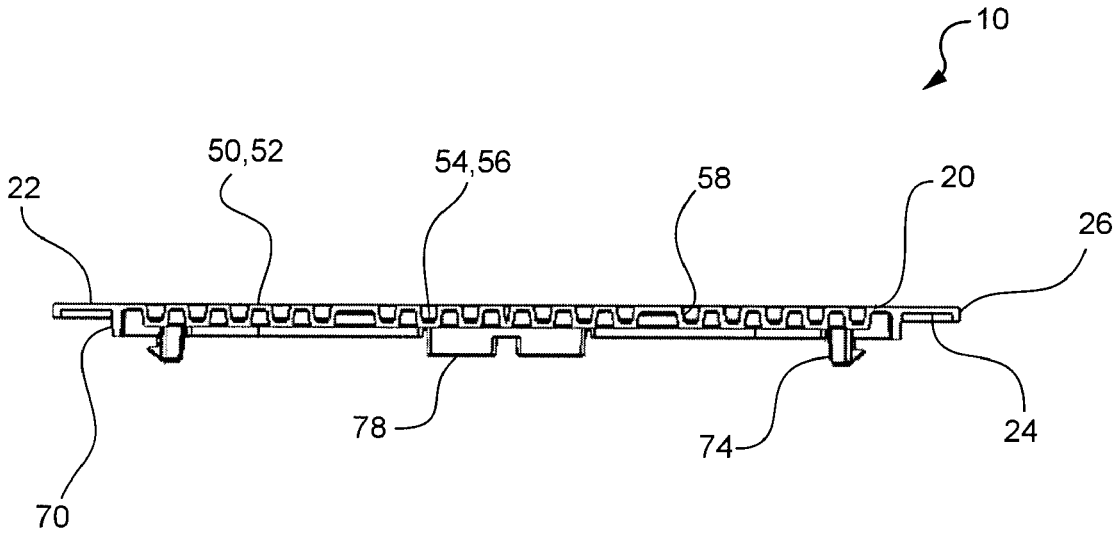
FIG. 6 illustrates a cross-sectional side view of the embodiment of FIG. 1, taken along the section line A-A in FIG. 2.
Figure 7A:
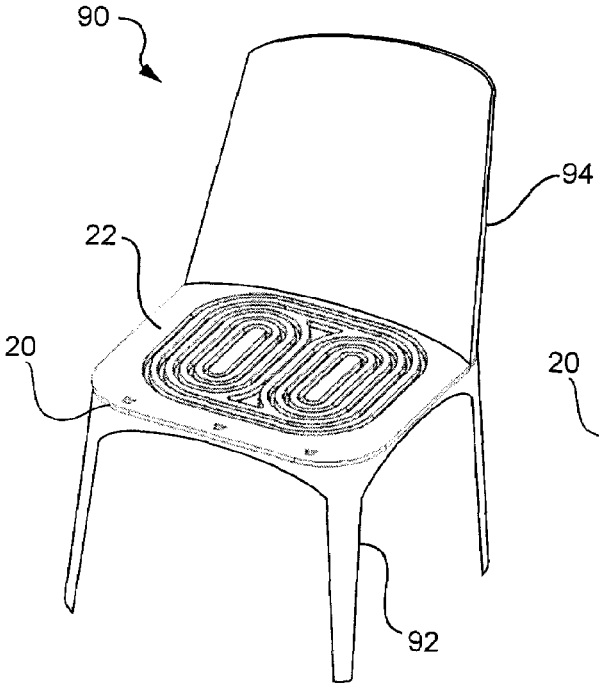
FIG. 7*a* illustrates a perspective top view of another exemplary embodiment of the present invention.
Figure 7B:
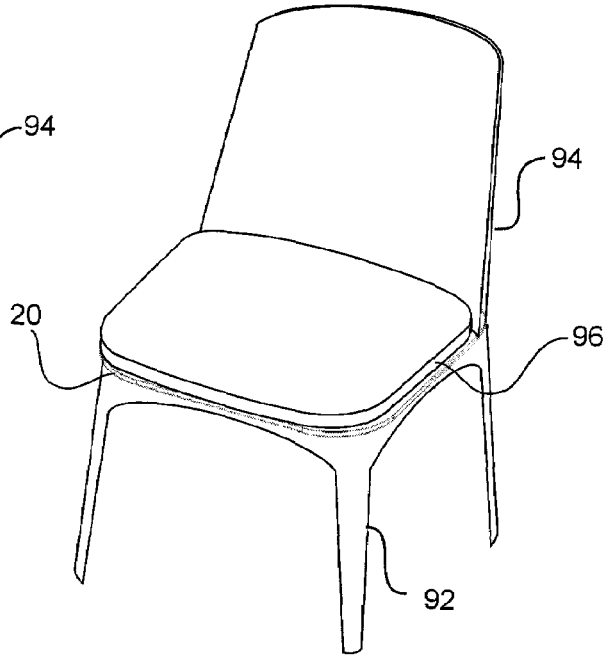
FIG. 7*b* illustrates a perspective top view of the embodiment of FIG. 6*a* with an attached seat cushion.

With reference to FIGS. 1, 2 and 6, illustrated is a flexible chair seat 10 according to an exemplary embodiment of the present invention. The chair seat can comprise a seat member 20 which is substantially planar in an unloaded or unused state. The seat member 20 can have a top surface 22 which is bounded by a side edge 26, and can be provided with a generally rectangular shape with rounded corners as shown. It is to be appreciated, however, that the shape of the seat member 20 can include any generally accepted shape for a chair seat known in the art, such as square, trapezoidal, oblong, circular, triangular, etc.

The seat member 20 can be formed from a single, monolithic piece of flexible material having a measure of ductility, such as plastic or other similar polymer material. Additional flexible materials, such as aluminum sheets or other ductile metallic structures, may also be considered. The flexible material can be configured to support the weight of the user while elastically yielding and bending under the anticipated load, and to return to its original position after removal of the load and without permanent deformation. In another aspect of the present invention, the single piece of flexible material can lend itself to simple, high-volume manufacturing techniques, such as injection molding or stamping, which can lead to economical and inexpensive production.

Formed in the center portion of the seat member 20 can be a pair of flex elements, or adjacent, corrugated regions 30 which are disposed side-by-side and configured for flexibly supporting the buttocks of the user. The corrugated regions 30 can further be defined as a series of alternating ribs 50 and slots 54 having rib tops 52 and slot bottoms 56, and which can be connected by substantially vertical sidewalls 58. The rib tops 52 can be co-planar with the top surface 22 of the seat member 20 in a non-flexed or unloaded condition, while the slot bottoms can be disposed below the seat surface 22.

The pair of adjacent, side-by-side corrugated regions 30 can be surrounded by a third flex element or corrugated region 40, which is concentric with the interior pair and configured for flexibly supporting the hips and thighs of the user, and which can have similar alternating ribs 50 and slots 54 having rib tops 52 and slot bottoms 56, and which can also be connected by substantially vertical sidewalls 58.

The pair of corrugated regions 30 can each include a center bar 32 which can define the center of the region 30, and which can align with the projected contact points of the buttocks of the user. In the embodiment of the present invention illustrated in FIGS. 1 and 2, the center bar 32 is a rib top 52 which contacts and supports the user. In an alternative embodiment, however, the center bar 32 could be configured as a slot bottom 54 to provide for more flexibility in the center and define a contact ring as providing the innermost contact point on the top surface 22. In like fashion, the transition rib or bar 42 and associated triangular slots 44, which together bridge the tap between the pair of interior corrugated regions 30 and the third surrounding corrugated region 40, can be reversed between rib tops or slot bottoms in an alternative aspect of the present invention. In other words, the transition bar 42 can be configured as a transition slot, and the triangular slots 44 can be likewise configured as triangular ribs.

A variety of alternating rib 50 and slot 54 configurations can be included within the scope of the present invention, to allow balancing of the degree of support vs. the degree of elasticity provided by the pair of side-by-side corrugated regions 30 and the third surrounding corrugated region 40, and to provide flexibility when fine-tuning the support and flexibility characteristics of the seat member 20. For instance, the width of the rib tops 52 can be greater than the width of the slot bottoms 56, the ratio between the rib top width and slot bottom width can vary across the seat surface 22, or the depth of the slots can change between adjacent corrugations, etc.

The alternating ribs 50 and slots 54 in the corrugated regions 30, 40 can be configured to form a plurality of discrete rows. The discrete rows can be oblong or annular, and as shown in the embodiment illustrated in FIGS. 1 and 2, can form a series of complete rings. The rings can be further described as a series of complete interior rings 36 concentric with the center bars 32 of the interior pair of corrugated regions 30, and a series of complete exterior rings 46 in the third concentric region 40 that are concentric with the center of the seat member 20.

Figure 3:
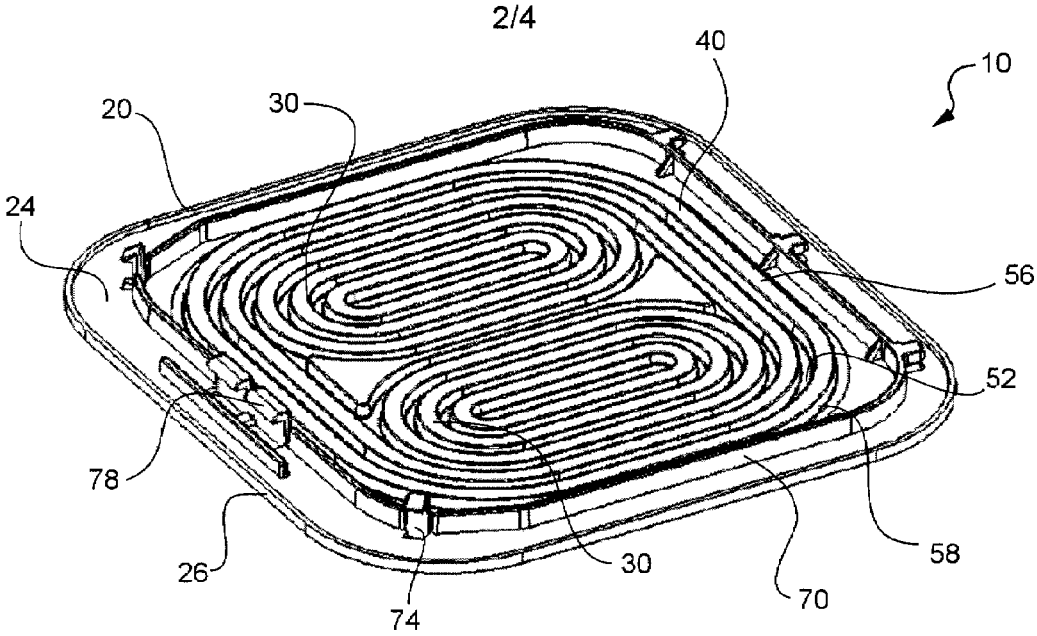
FIG. 3 illustrates a perspective bottom view of the embodiment of FIG. 1.
Figure 4:
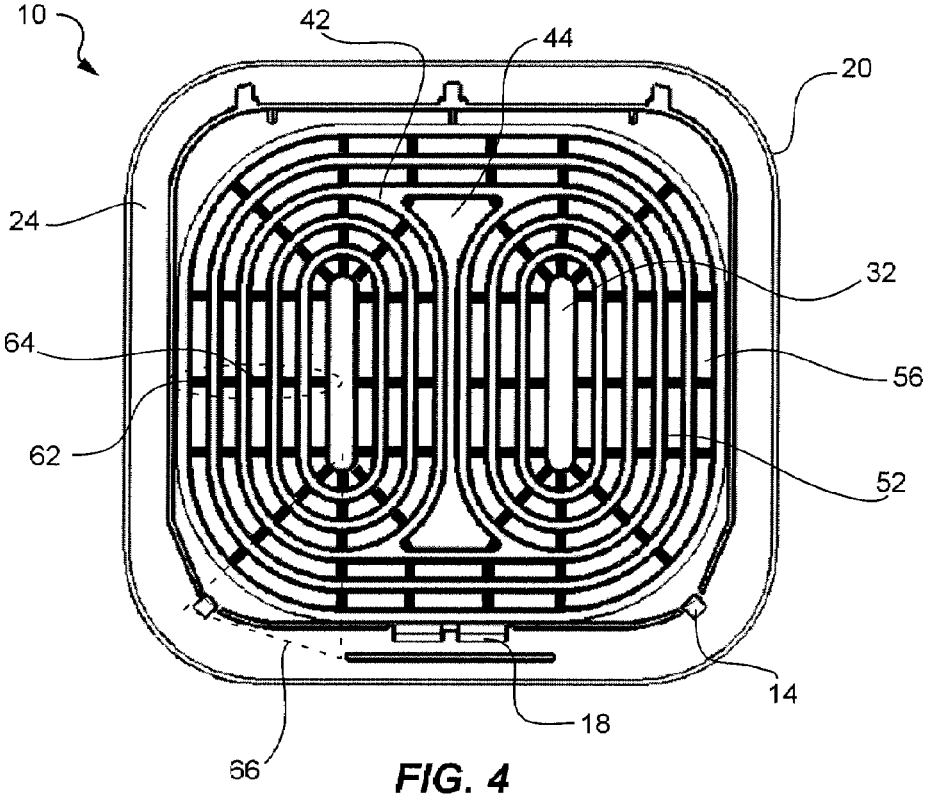
FIG. 4 illustrates a bottom view of the embodiment of FIG. 1.

The top surface 22 of the seat member 20 can include various surface features such as holes 14 or slots 18 which can be formed in and pass through the seat member 20 to allow attachment of additional seat components to the seat member, such as leg supports or a chair back. As can be seen in FIGS. 3 and 4, which together illustrate the bottom surface 24 of the seat member 20, the holes 14 and the slots 18 can align with hole tabs 74 and slot tabs 78. In another exemplary embodiment 90 of the present invention (see FIGS. 6*a* and 6*b*), a chair back 94 can be coupled to the seat member 20 from the top through the slots 18 to interconnect with the slot tabs 78. Furthermore, leg supports 92 can be attached from the bottom by interconnecting with the hole tabs 74, and with a support projection occupying the hole 14, but which does not extend far enough upwards to break the plane of the top surface 22, thus leaving a smooth, uniform seat surface. A variety of attachment methods and devices for coupling seat backs and leg supports to a seat member are well known in the art, and all can be considered to fall within the scope of the present invention.

The hole tabs 74 and slot tabs 78 can also provide attachment points for securing a cover or seat cushion 96 (see FIG. 6*b*) overlying the top surface 22 to the underside of the seat member 20. As is described in more detail below, the flex elements 30, 40 formed in the seat member 20 can provide the chair seat 10 with a high degree of flexibility, which can reduce the need for supplemental padding in the seat cushion. Thus, in one aspect of the present invention the seat cushion can be comprised of thinner or lower-density foam, as compared to the more expensive prior art high-density foam seat cushions required by less-flexible chair seats to maintain the same level of comfort. In another embodiment, a chair incorporating the flexible chair seat 10 of the present invention can include the same low-density foam in cushioning attached to the seat back, arm rests and other portions chair, etc.

Further illustrated in FIGS. 3 and 4 is a stiffening skirt 70 that can be indexed to the frame, and that can provide reinforcement for the structural attachment points or tabs 74, 78, and for supporting the un-deflected, outer portion of the seat member 20. Also shown are the underside surfaces of the seat member 24, rib tops 52, slot bottoms 56 and sidewalls 58 forming the pair of side-by-side corrugated regions 30 and the third surrounding corrugated region 40, as well as the undersides of the center bars 32, transition bar 42 and the triangular slots 44.

Both the pair of adjacent, side-by-side corrugated regions 30 and the surrounding third corrugated region 40 can be configured to deflect downwards with the respect to the seat surface 22 under load, such as when a user sits in the chair. The downward deflection can be progressive from the outer edge of the surrounding corrugated region 40 to the center bars 32 of the interior regions 30, to better conform to the shape of the user's body and reduce the number of pressure points. The deflection of the corrugations can be accordion-like, with each adjoining rib top and slot bottom pushed further downwards than its more outwardly positioned neighbor. This can be accomplished through minor twisting and bending of the separate rib tops, sidewalls and slot bottoms comprising each corrugation, which individually can be considered insignificant movement but cumulatively add up to a substantial deflection of the top surface 22.

To assist with the downward deflection, the present invention can include transverse notch lines 62 formed in the ribs 50 and slots 54 to allow for increased movement between corrugated regions across the seat member 20, as shown in FIGS. 2 and 4. The notch lines 62 can be comprised of multiple notches 64 aligned and cut in the corrugations to form a line. The longitudinal length of the transverse notch lines can be radially orientated with respect to one of the pair of adjacent, concentric corrugated regions, so as to separate the corrugated regions into multiple segments 66, some of which can be pie-shaped.

Figure 5:
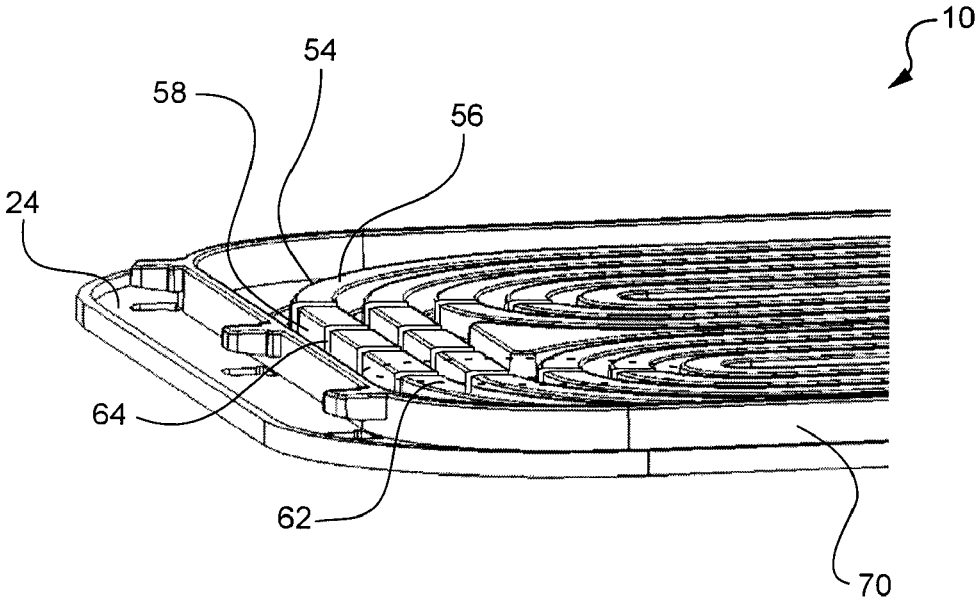
FIG. 5 illustrates a perspective bottom-side view of the embodiment of FIG. 1.

As best illustrated in FIG. 5, which provides a close-up, perspective view of the bottom-side of the seat member 20, the transverse notch lines 62 can be formed from individual notches 64 which cut through the slot bottoms 56 and sidewalls 58 of the slots. The notches do not cut through the rib tops, which become the coupling structures that bind the subdivided segments 66 of corrugated regions 30, 40 together. Thus, the notch lines 62 can allow for enhanced flexibility in the top surface 22 of the seat member 20, while the rib tops 52 provide a continuous yet conformable surface that comfortably supports the seated user. The number and placement of the notch lines can allow for fine tuning of the seat member's flexibility and durability.

Forming a flexible chair seat 10 having the flex elements of the present invention, specifically the corrugated regions 30, 40 formed from alternating ribs 50 and slots 54 that can be further bisected by transverse notch lines 62, creates a continuous yet highly flexible seat surface. The present invention can be more flexible than prior art chair seats made of comparable size and with similar materials, but which have flex elements of different types and configurations, or no flex elements at all. Through the application of the flexible elements of the present invention, a chair seat can be 200% to 400% more flexible than prior-related seat members, without stretching or deforming the seat material beyond its elastic limits. Consequently, designing for high flexibility through the use of the mechanical interactions between flex elements formed into the seat, rather than relying solely on the flexible properties inherent in the seat material itself, provides for a flexible seat member that stays within its elastic range to maximize durability and longevity without sacrificing performance.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given above.

What is claimed and desired to be secured by Letters Patent is:

1. A chair seat for flexibly supporting a buttocks of a user seated thereon comprising:

a seat surface;

a pair of adjacent concentrically corrugated regions formed in the seat surface and disposed side-by-side and configured for flexibly supporting the buttocks of the user, the pair of adjacent concentric corrugated regions being deflectable with respect to the seat surface;

a third corrugated region surrounding the pair of corrugated regions and configured for flexibly supporting the hips and thighs of the user, the third corrugated region being deflectable with respect to the seat surface;

the corrugated regions comprising alternating rib tops and slot bottoms connected by substantially vertical sidewalls, and the slot bottoms being disposed below the seat surface; and the corrugated regions comprising a plurality of transverse notch lines extending upwards through the slot bottoms and sidewalls and traversing the plurality of concentrically corrugated regions, wherein the notch lines are configured for facilitating the downward bowing of the seat surface under a load.

2. The chair seat of claim 1, wherein the rib tops are substantially co-planer with the seat surface in an unloaded state.

3. The chair seat of claim 1, wherein the width of the rib tops is substantially equal to the width of the slot bottoms.

4. The chair seat of claim 1, wherein a longitudinal length of the plurality of transverse notch lines is radially oriented with respect to one of the pair of adjacent concentrically corrugated regions.

5. The chair seat of claim 1, wherein the concentrically corrugated regions form a plurality of discrete rows.

6. The chair seat of claim 5, wherein the plurality of discrete rows are annular.

7. The chair seat of claim 5, wherein the plurality of discrete rows form complete rings.

8. The chair seat of claim 1, further comprising a foam covering disposed over the chair surface.

9. A chair for flexibly supporting a buttocks of a user seated thereon comprising:

a seat member further comprising:

a flexible seat surface;

a pair of adjacent concentrically corrugated regions formed in the seat member and disposed side-by-side and configured for flexibly supporting the buttocks of the user;

a third corrugated region surrounding the pair of corrugated regions and configured for flexibly supporting the hips and thighs of the user; and at least one chair support coupled to the seat member to elevate the seat member to a sitting height;

a back rest coupled to the seat member for resting a back portion of the user thereon;

the corrugated regions comprising alternating rib tops and slot bottoms connected by substantially vertical sidewalls, and the slot bottoms being disposed below the seat surface; and the corrugated regions comprising a plurality of transverse notch lines extending upwards through the slot bottoms and sidewalls and traversing the plurality of concentrically corrugated regions, wherein the notch lines are configured for facilitating the downward bowing of the seat surface under a load.

10. The chair of claim 9, wherein the width of the rib tops is substantially equal to the width of the slot bottoms.

11. The chair of claim 9, wherein the plurality of transverse notch lines are configured with a radially-orientated length.

12. The chair of claim 9, wherein the concentrically corrugated regions form a plurality of discrete rows.

13. The chair of claim 12, wherein the plurality of discrete rows are annular.

14. The chair of claim 12, wherein the plurality of discrete rows form complete rings.

15. The chair of claim 9, further comprising a low-density foam covering disposed over the seat member and back member.

* * * * *